US006236317B1

(12) United States Patent
Cohen et al.

(10) Patent No.: US 6,236,317 B1
(45) Date of Patent: May 22, 2001

(54) METHOD AND APPARATUS FOR MONITORING ACTIONS TAKEN BY A USER FOR ENHANCING HYGIENE

(75) Inventors: Glenn Cohen, Long Branch; James R. Disser, Oak Ridge; Mark Hersh, Howell, all of NJ (US); Ronald Heagle, Longboat, FL (US); Dan Richard, Sedona, AZ (US); Kevin Brady, Saugertis, NY (US)

(73) Assignee: Food Safety Solution Corp., Longboat Key, FL (US)

( * ) Notice: Subject to any disclaimer, the term of this patent is extended or adjusted under 35 U.S.C. 154(b) by 0 days.

(21) Appl. No.: 09/197,072

(22) Filed: Nov. 20, 1998

Related U.S. Application Data

(60) Provisional application No. 60/083,433, filed on Apr. 29, 1998.

(51) Int. Cl.[7] ..... G08B 23/00

(52) U.S. Cl. ..... 340/573.1; 340/286.09; 137/552.7; 4/623; 702/176; 222/39

(58) Field of Search ..... 340/573.1, 236.09, 340/825.54; 137/552.7; 4/623; 702/179; 222/39

(56) References Cited

U.S. PATENT DOCUMENTS 4,896,144 * 1/1990 Bogstad ..... 340/691
4,952,928 * 8/1990 Carroll et al. ..... 340/825.54
5,202,666 4/1993 Knippscheer ..... 340/573.1
5,204,670 * 4/1993 Stinton ..... 340/825.54
5,610,589 3/1997 Evans et al. ..... 340/573.1
5,621,384 4/1997 Crimmins et al. ..... 340/539
5,771,925 * 6/1998 Lewandowski ..... 137/552.7
5,793,653 * 8/1998 Segal ..... 702/176
5,808,553 * 9/1998 Cunningham ..... 340/573.1
5,810,201 * 9/1998 Besse et al. ..... 222/39
5,812,059 * 9/1998 Shaw et al. ..... 340/573.1
5,900,801 * 5/1999 Heagle et al. ..... 340/286.09
5,939,974 * 8/1999 Heagle et al. ..... 340/286.09
5,945,910 * 8/1999 Gorra ..... 340/573.1
5,952,924 * 9/1999 Evans et al. ..... 340/573.1
5,966,753 * 10/1999 Gauthier et al. ..... 4/623

* cited by examiner

*Primary Examiner*—Benjamin C. Lee
(74) *Attorney, Agent, or Firm*—R. Neil Sudol; Henry D. Coleman; William J. Sapone

(57) ABSTRACT

An apparatus and a concomitant method for promoting hygienic practices is disclosed. The apparatus is a monitoring unit for monitoring the completion of a desired action, e.g., handwashing, by a user. Upon completion of the desired action, the monitoring unit transmits a satisfactory signal to the user.

20 Claims, 13 Drawing Sheets

METHOD AND APPARATUS FOR MONITORING ACTIONS TAKEN BY A USER FOR ENHANCING HYGIENE

This application claims the benefit of U.S. Provisional Application No. 60/083,433 filed on Apr. 29, 1998, which is herein incorporated by reference.

The present application is related to the US application filed simultaneously herewith with Ser. No. 09/197,252 and to the US application filed simultaneously herewith with Ser. No. 09/197,262 now abandoned, which are hereby incorporated by reference.

The invention relates to an apparatus and concomitant method for enhancing hygiene. More particularly, the invention relates to an apparatus for promoting hygienic practices such as hand washing or alerting a user that he has encountered a "potentially unsanitary area".

BACKGROUND OF THE DISCLOSURE

It has been well known that unclean practices in facilities of food and health providers can cause the spread of diseases such as viral and bacterial infections. Restaurants, hospitals, food processing facilities and daycare centers are examples of facilities that are particularly vulnerable. Namely, bacterial and other microbial organisms can be easily transmitted from one infected individual to another individual. In fact, an individual can acquire or transmit the organisms through handling of an item, e.g., acquiring salmonella bacteria on one's hand through handling of raw poultry. However, the ease of transmission of these microbial organisms can be dealt with through proper sanitary practices.

More specifically, if an individual's hands have been contaminated, then it is often sufficient to remove the microbial organisms through the simple action of washing one's hand with soap. For example, an employee at a restaurant must wash his hands before leaving the restroom or a chef must wash his hands before preparing a salad after handling raw poultry. Although various governmental regulations have been enacted to address hygienic practices, compliance by employees are difficult to ascertain and to enforce.

Therefore, a need exists in the art for an apparatus and method to promote hygienic practices such as hand washing or alerting a user that he has encountered a potentially unsanitary area or item.

SUMMARY OF THE INVENTION

The present invention is an apparatus and a concomitant method for promoting hygienic practices. More specifically, the apparatus is a reminder and/or verification/monitoring system that may comprise a system controller, a communication channel, one or more "desired action monitoring units", one or more "user/area monitoring units", one or more indicators (e.g., badges), and one or more accessories, e.g., a badge rack, a badge port, or an exit station.

In operation, a user, e.g., an employee of a restaurant, is provided with a badge that is worn during working hours. The badge is designed to remind or alert the user (or a centralized station, e.g., the system controller), that the user has encountered a monitored area, e.g., a potentially unsanitary environment. Each badge contains the necessary circuitry to receive and/or transmit information. In turn, the reminder and/or verification/monitoring system is designed to detect the presence of a user within the monitored area and to subsequently determine if the user has performed a desired action, in light of his or her exposure to the "potentially unsanitary" environment. If the desired action is performed, the alert device on the indicator (e.g., a badge) is deactivated. If the desired action is not performed, the badge or another system component, e.g., the system controller or the desired action monitoring unit will record a violation.

Finally, various configurations of the present reminder and/or verification/monitoring system can be implemented based upon the deployment of the various system components. This allows the present reminder and/or verification/monitoring system to be adapted to different applications for promoting hygienic practices.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
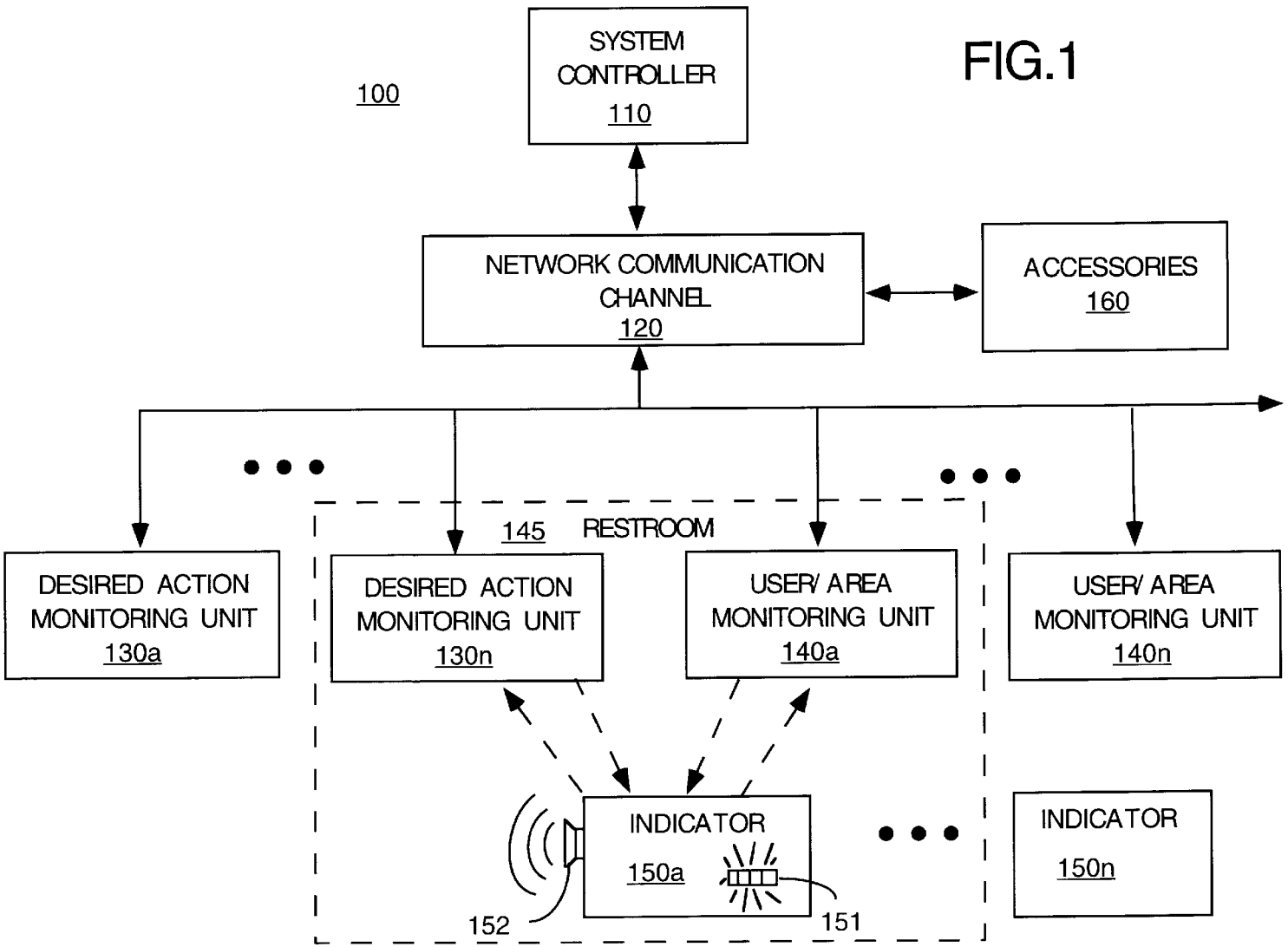
FIG. 1 depicts a block diagram of a reminder and/or verification/monitoring system of the present invention for promoting hygienic practices.

FIG. 1 depicts a block diagram of a reminder and/or verification/monitoring system 100 of the present invention for promoting hygienic practices. More specifically, reminder and/or verification/monitoring system 100 comprises a system controller 110, a communication channel 120, one or more "desired action monitoring units" 130*a–n*, one or more "user/area monitoring units" 140*a–n*, one or more indicators, e.g., badges 150*a–n*, and one or more accessories 160. The reminder and/or verification/monitoring system 100 is designed to detect the presence of a user within a monitored area, e.g., a "potentially unsanitary" environment and to subsequently determine if the user has performed a desired action, in light of his or her exposure to the "potentially unsanitary" environment. A badge can be implemented to record useful information such as the identification of the user and various violations, e.g., lack of performing the desired action.

In operation, all users, e.g., employees of a restaurant, are provided with badges 150 that are worn during working hours. These badges are designed to remind the user and/or alert a centralized station, e.g., the system controller, that the user has encountered a potentially unsanitary environment. Each badge 150 contains the necessary circuitry to receive and/or transmit information. In fact, the badge 150 contains various reminder indicators (audio, visual and/or tactile) that provide a compelling reminder to the user to perform a desired action upon being exposed to a potentially unsanitary environment. It should be understood that although the indicator 150 of the present reminder and/or verification/monitoring system 100 is implemented as a badge, the indicator 150 can be adapted into other devices that are worn by the user such as a bracelet, a cap, a belt attachment device and the like.

More specifically, in one embodiment, the user/area monitoring unit 140 is designed to transmit a periodic "directed" infrared signal toward a particular monitored area. For example, the user/area monitoring unit 140 can be mounted to the ceiling of a potentially unsanitary area, where it continuously broadcasts a periodic directed infrared signal. The badge 150 of a user who enters the potentially unsanitary area will respond to the periodic directed infrared signal by activating one or more indicators, e.g., a red light 151 on the badge, to alert the user that a potentially unsanitary environment has been encountered.

Although the present invention describes a user/area monitoring unit that transmits a periodic signal, i.e., without the need of an external triggering mechanism, it should be noted that external triggering devices or switches can be optionally employed to cause the user/area monitoring unit to transmit a signal. For example, a switch or motion detector (not shown) can be deployed on a restroom door or within the restroom, respectively, to trigger the user/area monitoring unit upon being opened. However, the use of such external triggering devices will increase the complexity and cost of the monitoring system.

In order to deactivate the indicator on the badge 150, the user must perform a desired action that is being monitored by a desired action monitoring unit 130. Namely, the desired action monitoring unit 130 contains the necessary circuitry to monitor the user's action and to communicate a satisfactory signal to the badge 150 upon completion of the desired action. Responsive to the satisfactory signal, the badge 150 will deactivate the indicator. However, if a satisfactory signal is not received (generally within a predefined period of time, e.g., ten minutes (violation time)) by the badge 150, then a violation is logged, and/or the indicator may remain activated, and/or a more compelling indicator such as a speaker 152 is triggered.

Thus, the desired action monitoring unit 130 and the user/area monitoring unit 140 are illustratively shown as deployed in a restroom 145 to monitor the desired action of handwashing by the user. It should be understood that the present invention can be implemented to monitor any "potentially unsanitary environment" such as areas within a kitchen in part or in whole, a hospital, a food processing plant and so on. In fact, due in part to the present invention's ability to broadcast a directed signal, any desired areas can be monitored as required for a particular implementation.

Returning to FIG. 1, the violations are then accumulated and reported to the system controller 110, which serves as the central controller for the overall monitoring system. More specifically, the system controller 110 can be implemented using a general purpose computer having a central processing unit (CPU), a memory (e.g., RAM) and a plurality of input/output devices such as a ROM, storage devices such as magnetic or optical disk drives, a keyboard, a display, a mouse, communication ports, a printer, a modem and the like. Various monitoring and reporting functions discussed below can be implemented via software applications that are loaded into the memory and executed by the CPU.

The system controller can be either centrally or locally implemented. If the system is centrally implemented, the system controller controls a network of desired action monitoring units 130*a–n* and/or user/area monitoring units 140*a–n*.

If the system controller is locally implemented, then it is integrated into the CPU of the desired action monitoring unit 130 (e.g., a sink monitoring unit (SMU) as discussed below) and the desired action monitoring unit controls the actions of the badges at each individual location. In a local system implementation, central collection and reporting of data can be omitted. In turn, data stored in each local desired action monitoring unit can be physically downloaded into an optional portable collection device. The collection device can then be connected to a personal computer (PC) where the collected data is uploaded and processed.

In brief, the system controller 110 is designed to perform various monitoring and control functions to promote hygienic practices. Namely, the system controller 110 sends and receives information via the communication channel 120 through the various monitoring units 130 and 140, which can be broadly perceived as transmitters and/or receivers. By communicating with the badge 150 through polling via infrared communication with the desired action monitoring unit 130, the system controller 110 is able to determine if a user has performed the desired action upon coming into contact with a potentially unsanitary environment.

Finally, a plurality of accessories 160 are further described below which include, but are not limited to a "badge rack" (indicator rack), a "badge port" and an "exit station", which are designed to receive and store the badges, e.g., at the end of the work shift. More specifically, the badge rack is designed to store badges and to activate the badge's shutoff circuit. The badge port and exit station are designed to send commands that control badge functions.

Detailed descriptions of all the components of the reminder and/or verification/monitoring system 100 are provided below. However, it should be understood that the components of the present reminder and/or verification/monitoring system 100 can be implemented in different configurations to produce different novel monitoring systems of varying complexity and cost. Namely, a comprehensive monitoring system may incorporate every described components, whereas a less comprehensive monitoring system may only incorporate some of the described components.

Figure 2:
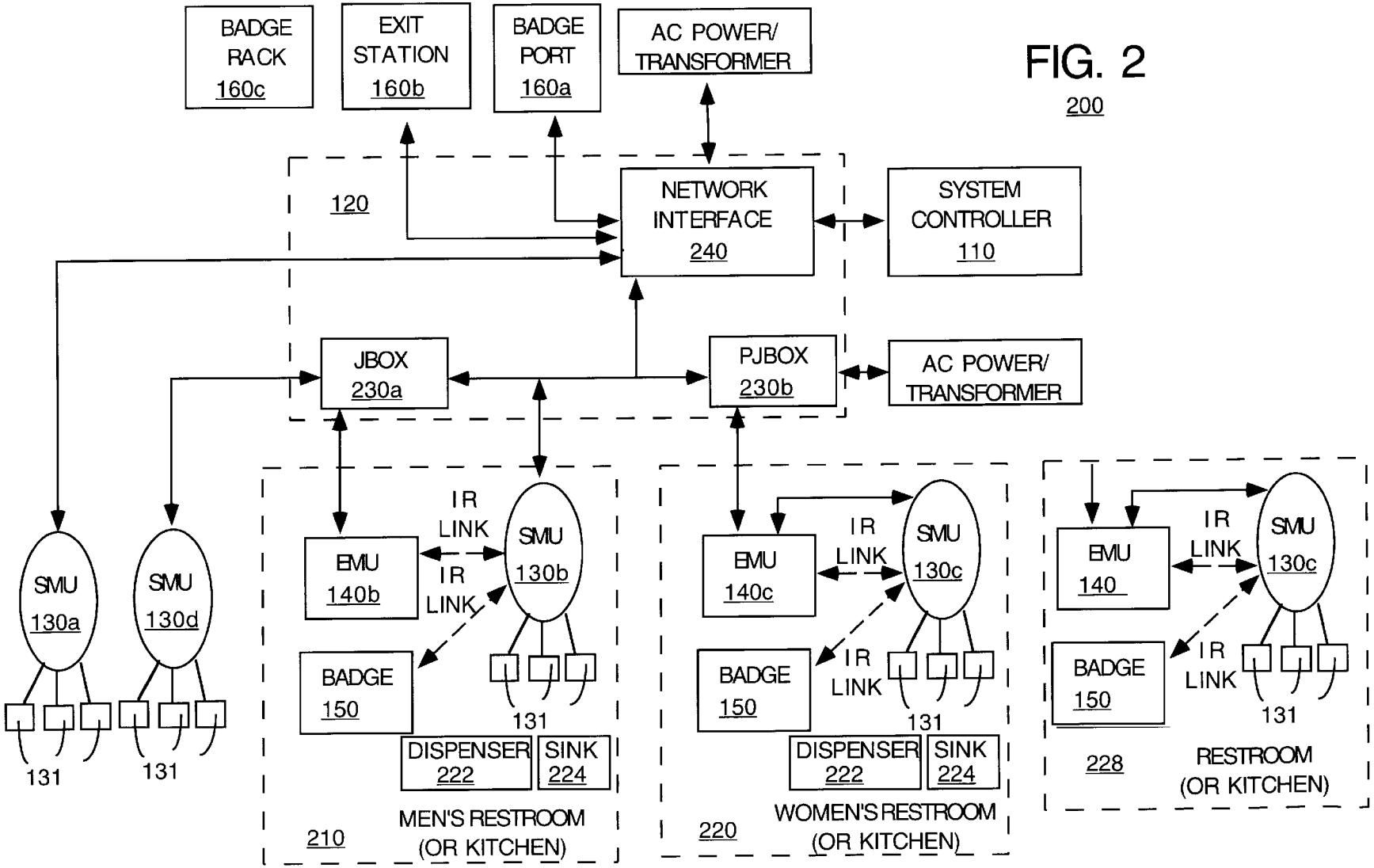
FIG. 2 depicts a block diagram of a reminder and/or verification/monitoring system of the present invention for promoting hygienic practices such as hand washing in restrooms.

FIG. 2 depicts a block diagram of a reminder and/or verification/monitoring system 200 of the present invention for promoting hygienic practices such as handwashing in restrooms (or any other monitored areas such as a kitchen).

In this embodiment, the restrooms are deemed to be a "potentially unsanitary environment". The reminder and/or verification/monitoring system 200 comprises a system controller 110, a network communication channel 120 (a network interface 240 and a junction box 230*a* and a power junction box 230*b*), a badge port 160*a*, an exit station 160*b*, a badge rack 160*c*, a plurality of sink monitoring units (SMU) 130, a plurality of employee monitoring units (EMU) 140, and a plurality of badges 150.

More specifically, the system controller 110 performs the same monitoring and control functions as discussed above in FIG. 1, whereas the SMU (a desired action monitoring unit) 130 is deployed near a sink to monitor the desired action of hand washing. Similarly, the EMU (a user/area monitoring unit) 140 is deployed inside the restroom to effect detection of the presence of an employee in a monitored area, e.g., in the restroom. In the preferred embodiment, the EMU performs its monitoring function by broadcasting a directed infrared signal periodically (e.g., every 0.075 seconds). In turn, if an employee wearing a badge 150 is within one of the restrooms 210 and 220, then the badge in response to the periodic directed infrared signal, will indicate that it has encountered a potentially unsanitary environment by illuminating a light, a buzzer, and/or a tactile reminder indicator on the badge.

If the employee executes the desired action, then the SMU having a plurality of sensors/controls 131 (discussed below) will communicate a satisfactory signal to the badge for deactivating the light indicator. The desired action in this embodiment includes depressing the soap dispenser 222 and/or placing the employee's hands within a wash sink 224. The desired action can be communicated to the SMU in a number of different methods. For example, electrical signals from various sensors/controls 131 (e.g., electrical circuits) deployed on the soap dispenser and proximate to the wash sink can be passed directly to the SMU. Such circuits may include, but are not limited to electrical switches disposed on the soap dispenser, proximity sensors and motion detectors directed toward the wash sink and the like.

It should be understood that a series of desired steps or actions can be tailored to a particular implementation of the present invention. As such, depending on the nature of the potentially unsanitary environment, the desired action monitoring unit can be adapted to receive a different set of signals and/or monitor a different set of desired actions, e.g., taking disposable gloves or washcloths from a dispenser, washing a surface and the like.

FIG. 2 also illustrates a SMU 130*a* deployed outside of the restrooms. This configuration illustrates the concept of allowing the deactivation of the reminder indicator on the badge to be accomplished outside of the potentially unsanitary environment. For example, some potentially unsanitary environments may require the desired actions to be performed away from the immediate potentially unsanitary environments. 560/011

In fact, FIG. 2 illustrates a restroom 228 that is monitored without the need of a centralized system controller. Namely, the system controller can be locally implemented within a SMU.

The reminder and/or verification/monitoring system 200 also employs a network communication channel 120 comprising a network interface 240 and junction boxes 230*a* and 230*b*. The network interface 240 contains the necessary circuitry to foster communication between the system controller 110 and the various system components. For example, in the preferred embodiment the network interface 240 communicates with the system controller 110 via the standard RS232 communication protocol, whereas the network interface 240 communicates with the system components using a unique communication bus with six (6) conductors. Thus, the network interface 240 serves as a converter between the system controller and the various system components. However, it should be understood that the network interface 240 can be omitted if a common communication protocol is implemented between the system controller and the various system components. A detailed description of the network interface 240 is provided below with reference to FIG. 8.

The junction box 230*a* is implemented to provide a distribution junction, where signals from the system controller can be communicated to a plurality of system components. Namely, junction box 230*a* is simply a connector. Furthermore, if the system components are located over a great distant from the system controller, the distribution junction can be selectively deployed to maintain or bolster the strength of the communication signals.

The power junction box 230*b* is a connector and a power supply. It has been observed that transmission of power on very long wires along with communication signals can create noise problems. As such, the power junction box 230*b* can be employed to address this noise problem if system components are deployed over great distances. Namely, the power junction box 230*b* draws power from a local power source for distribution to other system components.

Finally, accessories such as badge port or rack 160*a* and exit station 160*b* serve as receptacles for receiving the badges from the employees during non-working hours. These accessories are designed with the necessary circuitry to download information stored within the badges, e.g., the number of violations that were recorded for a particular period of time. In fact, these accessories allow the system controller to configure a plurality of badges simultaneously.

More specifically, the exit station 160*b* is used to clock users (e.g., employees) in and out and to control a timer (a periodic timer) in the "Timed Interval Mode". Namely, the Timed Interval Mode starts another timer (a violation timer) at the end of preprogrammed intervals, e.g., every 30 or 60 minutes, to periodically remind an employee to perform a desired action. This periodic reminder continues to occur while the periodic timer is activated. Without the exit station, badges stored while employees are not at work will continue to start the timer and generate infractions. Thus, the exit station deactivates the timer when an employee clocks out or exits the facilities. The exit station activates the timer when the employee clocks in and simultaneously starts the timer to require a desired action, e.g., washing prior to the start of work.

Figure 3:
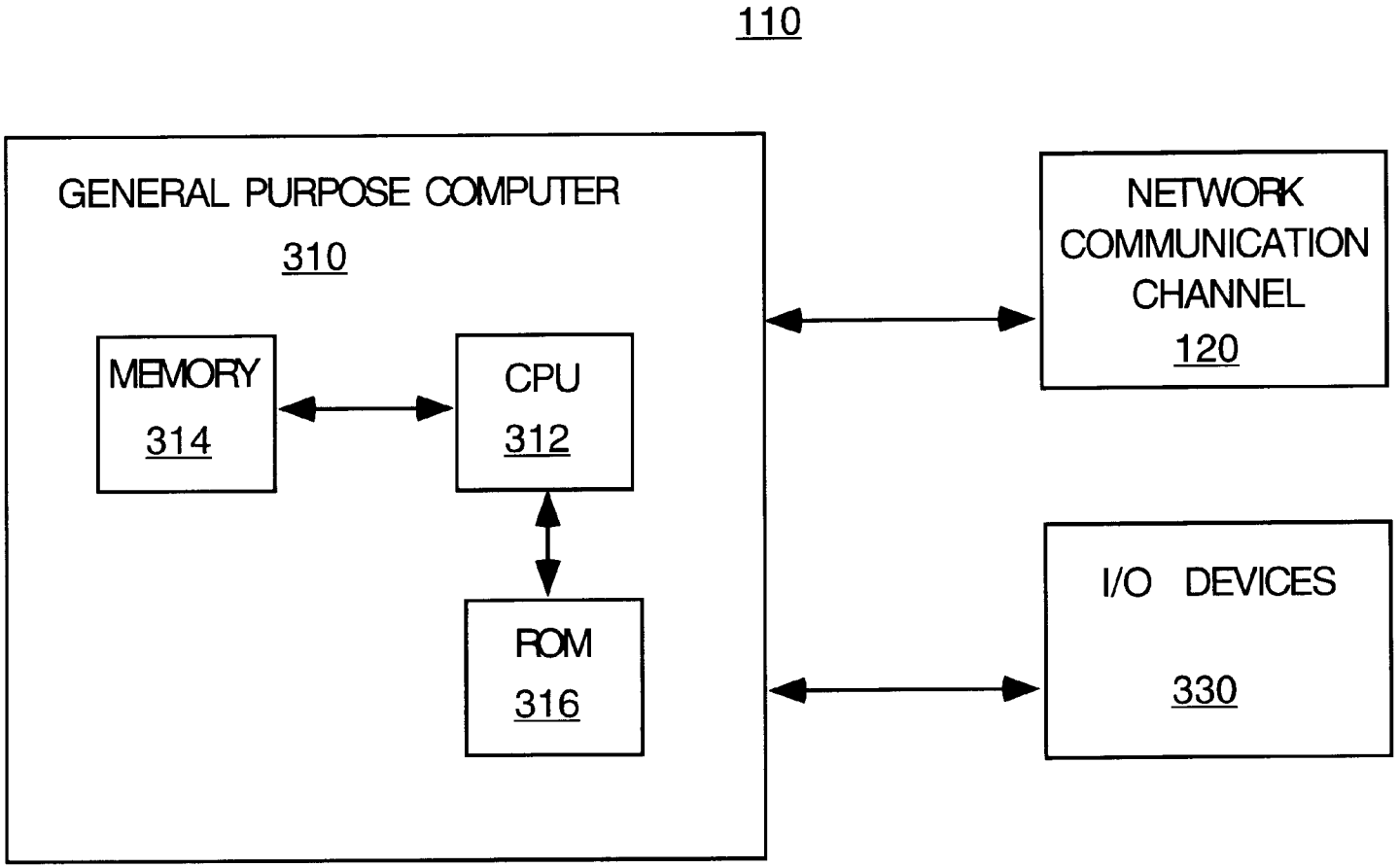
FIG. 3 illustrates a block diagram of the system controller of the present invention.

FIG. 3 illustrates a block diagram of the system controller 110 of the present invention. The system controller comprises a general purpose computer 310, and a plurality of I/O devices 330. The I/O devices include, but are not limited to, a printer, a display, a modem, a keyboard or keypad, a touch screen, a mouse, storage devices such as magnetic and optical drives (using tape or disk). The system controller serves to control and monitor the various system components of the monitoring system, i.e., the SMUs 130, the EMUs 140, the badges 150 and various accessories 160. The system controller communicates with the system components via a network interface 120.

More specifically, in the preferred embodiment, the CPU 312 is employed to execute stored instructions for implementing various functions or feature of the reminder and/or verification/monitoring system 100. The CPU is capable of detecting input signals, performing logical operations and generating output signals. The memory 314 and ROM 316 are employed to stored data and instructions (software) which can be retrieved and executed by the CPU.

First, the system controller 110 is designed to control the network, e.g., resolving communication conflicts among the system components. For example, the system controller will control a SMU and an EMU such that only one of these system components is in communication with a badge 150. Otherwise, a communication conflict may result from having both SMU and EMU sending a signal to the badge.

Second, the system controller 110 is designed to receive and process the information that is collected by the reminder and/or verification/monitoring system 100. This information allows the reminder and/or verification/monitoring system to monitor the hygienic practices of a plurality of users. The information includes but are not limited to: 1) information specific to a user, e.g., ID number, 2) the time, frequency and locations of potentially unsanitary environments encountered by the user throughout a work shift, 3) the user's compliance to hygienic practice (completing a desired action) upon encountering such potentially unsanitary environments, i.e., recording a violation for each non-compliant event and the like. A report can then be generated from this information.

For example, reporting options may include, but are not limited to: 1) reports on each hand wash by location, 2) all hand washes for a designated period of time, 3) all violations and incomplete hand washes for a designated period of time (e.g., exception report), and 4) the preceding categories further broken down by the following criteria: a)specific employee, b) specific monitored area, c) specific time period, e.g., one shift every day and the like. Alternatively, a summary report that provides a list of all employees along with their total number of hand washes, violations and incomplete washes can also be generated. Namely, once the data is collected, various statistics can be complied into various desired reports.

Figure 4:
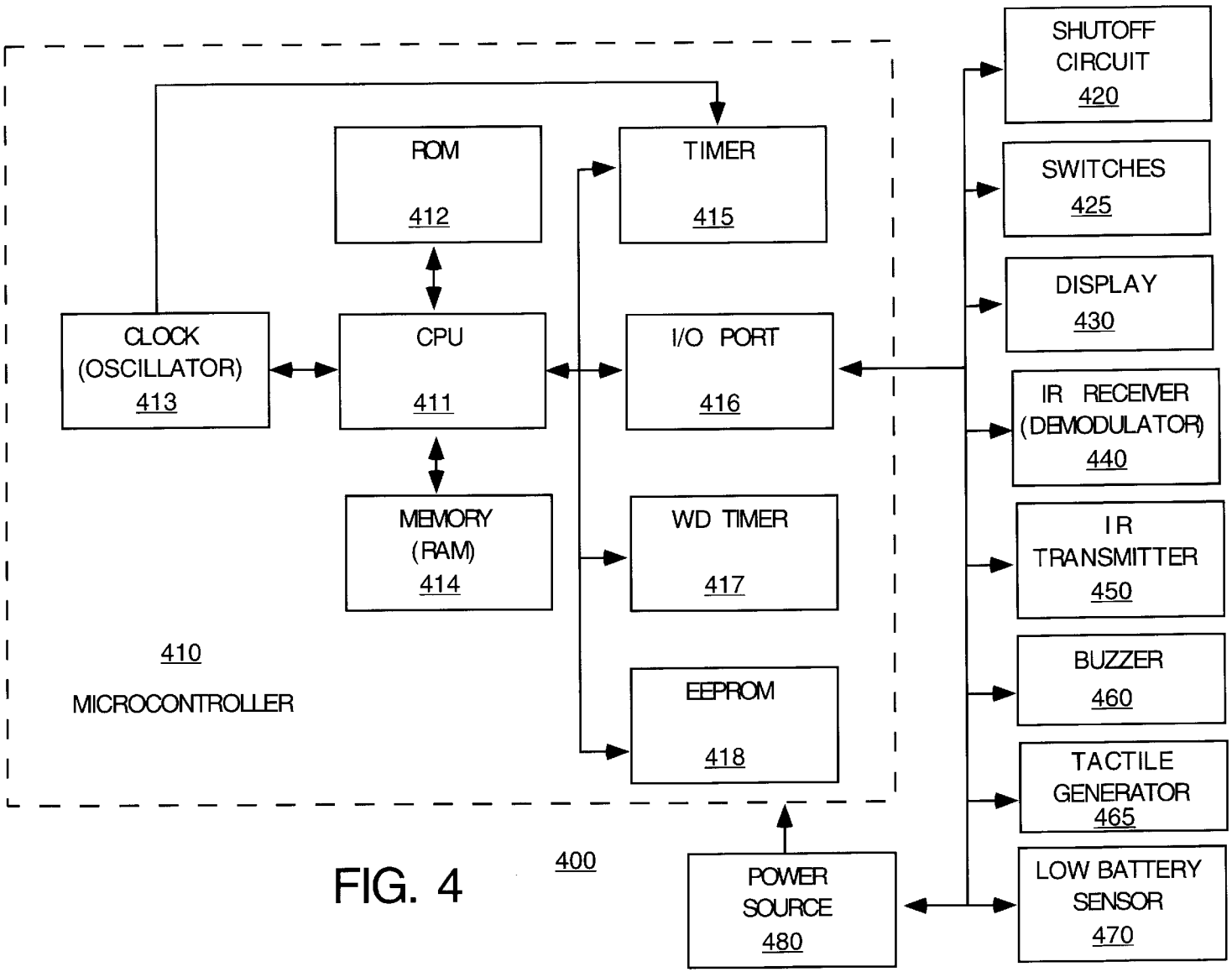
FIG. 4 depicts a block diagram of a badge of the present invention.

FIG. 4 depicts a block diagram of a badge 400 of the present invention. In the preferred embodiment, the badge 400 comprises a central processing (CPU) 411, a memory (RAM) 414, a read only memory (ROM) 412, an oscillator 413, one or more timer 415, an I/O port 416, a second timer 417, an EEPROM 418, a shutoff circuit 420, one or more switches 425, a display (a reminder indicator) 430, an IR demodulator 440, an IR transmitter 450, a buzzer or speaker (a reminder indicator) 460, a tactile generator (a reminder indicator) 465, a low battery sensor 470 and a power source 480. In the preferred embodiment, various components of the badge are implemented using a microcontroller 410, e.g., microcontroller PIC16C63-04/SO from Microchip.

More specifically, in the preferred embodiment, the CPU 410 is employed to execute stored instructions for implementing various functions of the badge. The CPU is capable of detecting input signals, performing logical operations and generating output signals. The memory 414, ROM 412 and EEPROM 418 are employed to store data and instructions (software) which can be retrieved and executed by the CPU. The EEPROM serves the function of storing certain information that must be retained if the power source is interrupted. Such key information may include, but is not limited to, recorded violations and the badge ID. The clock 413 serves to provide machine cycle for the CPU and the timer 415.

The badge 400 is designed to provide various features which can be implemented in full or in part in accordance with a particular implementation. These features are now described with the relevant sections of the badge.

The badge has a power source 480 which is implemented using batteries, e.g., lithium batteries (e.g., Panasonic CR2032). The selection of the battery type is a function of the application, but it is generally desirable to minimize the weight, size and cost of the badge. As such, the badge is implemented with an automatic shut-off circuit 420 to minimize power consumption. The shut-off circuit 420 incorporates a photo-transistor that detects ambient light. Thus, when the badge is returned to a specially designed badge rack, the lack of ambient light causes the CPU 411 to shut off the badge, thereby extending the useful life of the battery.

Similarly, a low battery sensor 470 provides the feature of detecting a low battery condition within the badge. Since the badge is employed in a reminder and/or verification/monitoring system to promote hygienic practices, it is important to provide a reliable badge that requires little maintenance. Thus, reducing the frequency of having to replace the batteries is a desirable feature.

The badge provides yet another battery life extending feature, where the CPU is capable of turning off the oscillator 413 under software control, i.e., the CPU goes into a "sleep mode" to reduce power consumption. During the sleep mode, the oscillator 413 is stopped, thereby disabling the CPU from executing any machine cycles. Thus, a watch-dog (WD) timer 417 which has its own oscillator, is implemented to periodically activate the CPU. The watch-dog timer provides a means to restart the CPU.

The badge 400 also provides a feature where a reminder indicator (light, sound or tactile sensation) on the badge is triggered within a predetermined period of time. This predetermined period of time can be selectively defined, e.g., a time duration in which the badge is activated by an EMU (violation timer) or a time duration in which the badge has been removed from the badge rack (periodic timer) and so on.

Thus, switches 425 are implemented to turn on and off various reminder indicators (buzzer 460, tactile generator 465 (e.g., a motor that generates a vibration) and/or display 430), change their frequency and duration, and to alter the periodic time value to generate an audio, tactile and/or visual signal. In the preferred embodiment, these controls are implemented by IR commands sent via a Badge Port. Since the badges are employed in different applications, these switches allow flexibility to the user without having to return the badges to the manufacturer for resetting various functions or values, e.g., the predefined period of time.

The badge 400 also provides a communication feature where information can be sent and received by the badge via an infrared transmitter 450 and an IR receiver 440, respectively. In one embodiment, the IR receiver 440 (e.g., a demodulator TFMM5380 from Temic) receives a directed infrared signal from the EMU to indicate that a potentially unsanitary environment has been encountered. The IR receiver 440 is also designed to receive other signals such as a satisfactory signal from the SMU upon completion of a desired action. In fact, any number of signals (commands) can be crafted to be received by the IR receiver, which is described in detail with reference to FIG. 5.

The infrared transmitter 450 allows the badge to transmit information to the monitoring system. More specifically, the badge can be designed to store information such as user information (e.g., user id and the like) and/or violations (recorded events indicating that a desired action was not performed upon encountering a potentially unsanitary environment). In one embodiment, the stored information is communicated from the transmitter 450 of the badge to a SMU. A detailed description of the IR transmitter is provided below with reference to FIG. 6.

Figure 5:
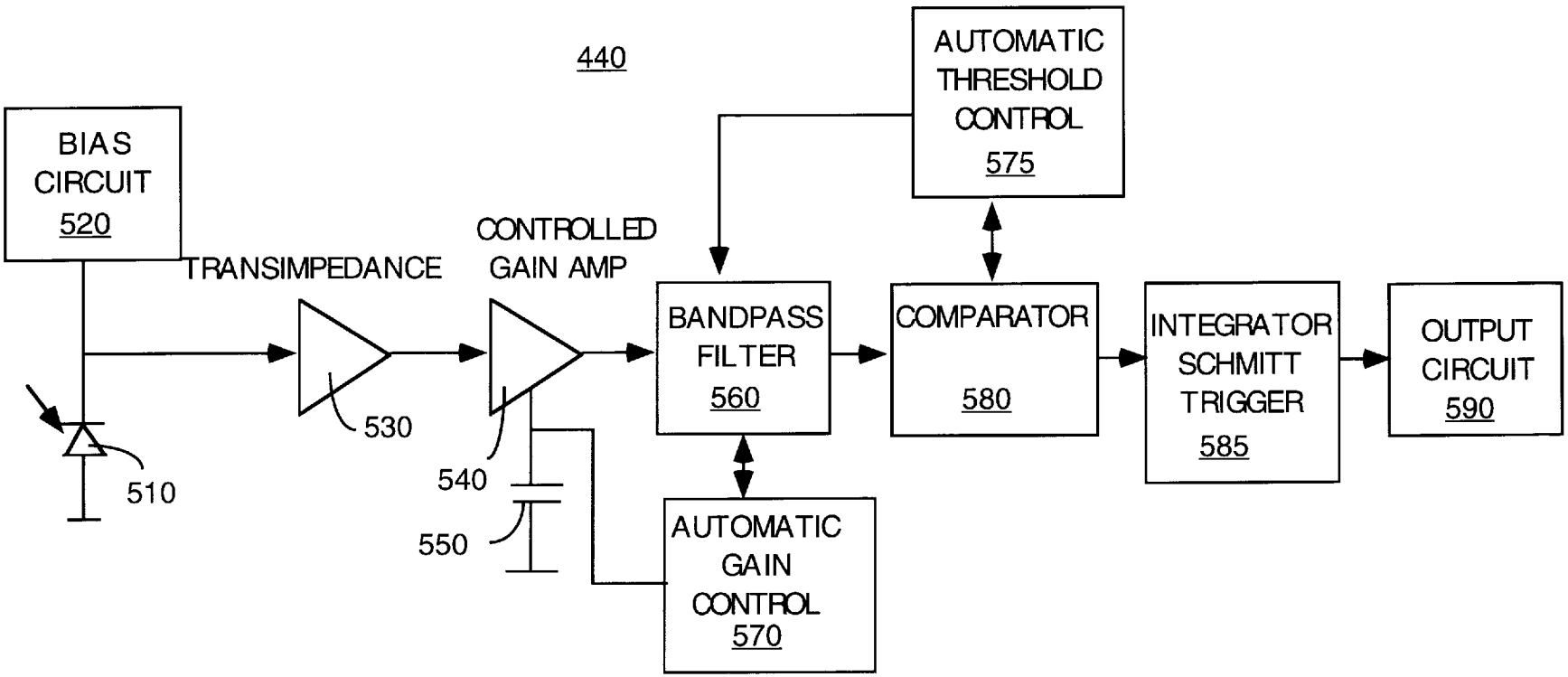
FIG. 5 illustrates a block diagram of the IR receiver (demodulator) of the present invention.

FIG. 5 illustrates a block diagram of the IR receiver (demodulator) 440 of the present invention. The IR receiver comprises a photo diode 510, a bias 520, a transimpedance amplifier 530, a controlled gain amplifier 540, a capacitor 550, a bandpass filter 560, an automatic gain control 570, a comparator 580, an automatic threshold control 575, and an integrator schmitt trigger 585.

More specifically, the photo diode 510 is a semiconductive device that generates an output that is proportional to the amount of light illuminating onto the diode. Such diodes are well known and are generally designed to be responsive to selected wavelengths of light. In the preferred embodiment, the photo-diode is responsive to infrared.

The bias circuit 520 provides power to the photodiode 510 and also acts as a load with a high impedance (greater response) for frequencies near the carrier frequency and low impedance for frequencies below the carrier and DC, thereby reducing noise.

The response of the photodiode and bias circuit 520 is a current. The transimpedance amplifier then coverts the current into a voltage.

The voltage is amplified by the controlled gain amplifier 540, where the gain is controlled by the automatic gain control 570. The amplified voltage signal is then received by the bandpass filter 560 which is centered on the modulation frequency, set at 38 kHz. in the preferred embodiment. The automatic gain control 570 serves to control and detect the amplitude of the voltage signal passing through the bandpass filter 560 and controls the gain in the controlled gain amplifier 540 such that the signal from the bandpass filter 560 is at point where the amplifier is not saturated, i.e., at a point where the amplifier can still react to an input.

The output from the bandpass filter is compared by the comparator 580 with a threshold selected by the automatic threshold control 575. The automatic threshold control 575 is designed to set a threshold that is just above a stabilized output level from the bandpass filter. Namely, the threshold serves to determine if the output from the bandpass filter is a valid signal for allowing an output to be generated from the demodulator 440. Since it is anticipated that the present badge may encounter other devices that operate near or at the same carrier frequency, the automatic threshold control 575 is designed to adjust the threshold to account for such interference, e.g., fluorescent lighting. However, the automatic threshold control is designed such that it will not adjust the threshold prematurely in response to short changes in the bandpass output, e.g., the actual data signal. The data format of the present invention is also designed to be compatible with the automatic threshold control such that the carrier presence of the data signal is interrupted by zeros, i.e., gaps in the carrier presence. This data format prevents the automatic threshold control from adjusting the threshold in response to the carrier presence of the data signal. Thus, the present demodulator 440 is an adaptive threshold IR demodulator.

Next, the integrator schmitt trigger 585 requires the output from the comparator 580 to remain at the active state for a predefined period of time before an output signal is generated by the output circuit 590 of the demodulator. Namely, this active state period allows the integrator schmitt trigger to exclude signals attributed to "noise".

Figure 6:
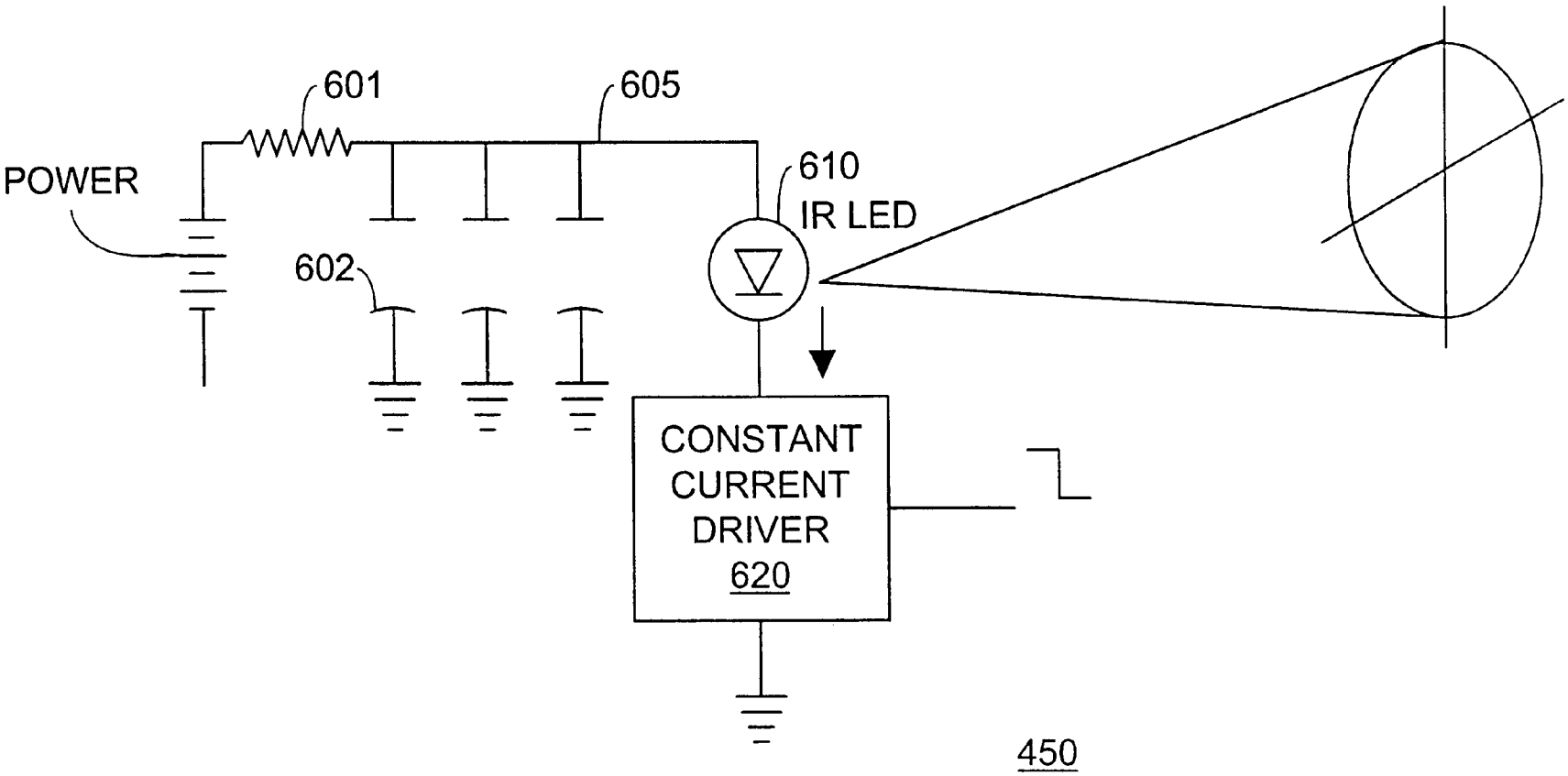
FIG. 6 illustrates a block diagram of the IR transmitter of the present invention.

FIG. 6 illustrates a block diagram of the IR transmitter 450 of the present invention. The IR transmitter comprises an IR light emitting diode (LED) 610 and a constant current drive circuit 620.

More specifically, the IR LED (e.g., an IRLED DN1102W from Stanley) 610 draws power from path 605 and illuminates in accordance with a predefined signal that is being transmitted. The IR LED 610 can be oriented such that the transmitted signal is an IR directed signal. Namely, the IR LED 610 is oriented such that the transmitted IR signal is broadcasted within a directed volume of space ("transmission volume"), e.g., a cone shaped volume of space as illustrated in FIG. 6. This unique feature of the badge 400 allows the placement of a plurality of desired action monitoring units 130 and user/area monitoring units 140 to monitor the presence of a user and the performance of a particular set of desired actions by that user. For example, the limited transmission volume ensures that if a desired action monitoring unit 130 receives a signal from a badge, then the user of the badge must be positioned within a particular location relative to the desired action monitoring unit 130. This information can be used advantageously to presume that the user may have performed the desired action being monitored. Similarly, the limited transmission volume ensures that the user is within the monitored area.

The constant current drive circuit 620 serves to set a constant current passing through the IR LED 610, i.e., to maintain a constant illumination by the IR LED throughout the entire data transmission period. Since the CPU modulates the light produced by the IR LED to the carrier frequency of the demodulator, the IR LED 610 must produce enough light to transmit to the monitoring unit located a distance away, e.g., several feet away. This requires a current passing through the IR LED to be in excess of what can be supplied by the battery.

More specifically, the resistor 601 limits the current that the circuit can draw to a value that can be supplied by the battery. The capacitors 602 (three capacitors are employed) store energy during the time period that the badge 150 is not transmitting. When the badge begins to transmit, the capacitors supply the required high current pulses. The constant current circuit 620 controls the amount of energy being drawn from the capacitors. The current is limited and the capacitors are sized in such a way that the capacitors are able to supply current throughout the transmission time period without depleting its stored energy. In the preferred embodiment, each capacitor is a tantalum surface mount type package (22 uf, 6.3 volt).

If the capacitors were allowed to discharge without the constant current circuit, then the initial current value would be much higher than the final value. This would lead to a requirement for either a very large capacitor, which is impractical in a small badge or a very small initial value of current, which is impractical since the transmission range would be insufficient. By incorporating the constant current drive circuit 620, the badge can ensure that the last data bit is illuminated with a similar intensity as the first data bit. The constant current circuit 620 is not required to be very accurate or precise.

Figure 7:
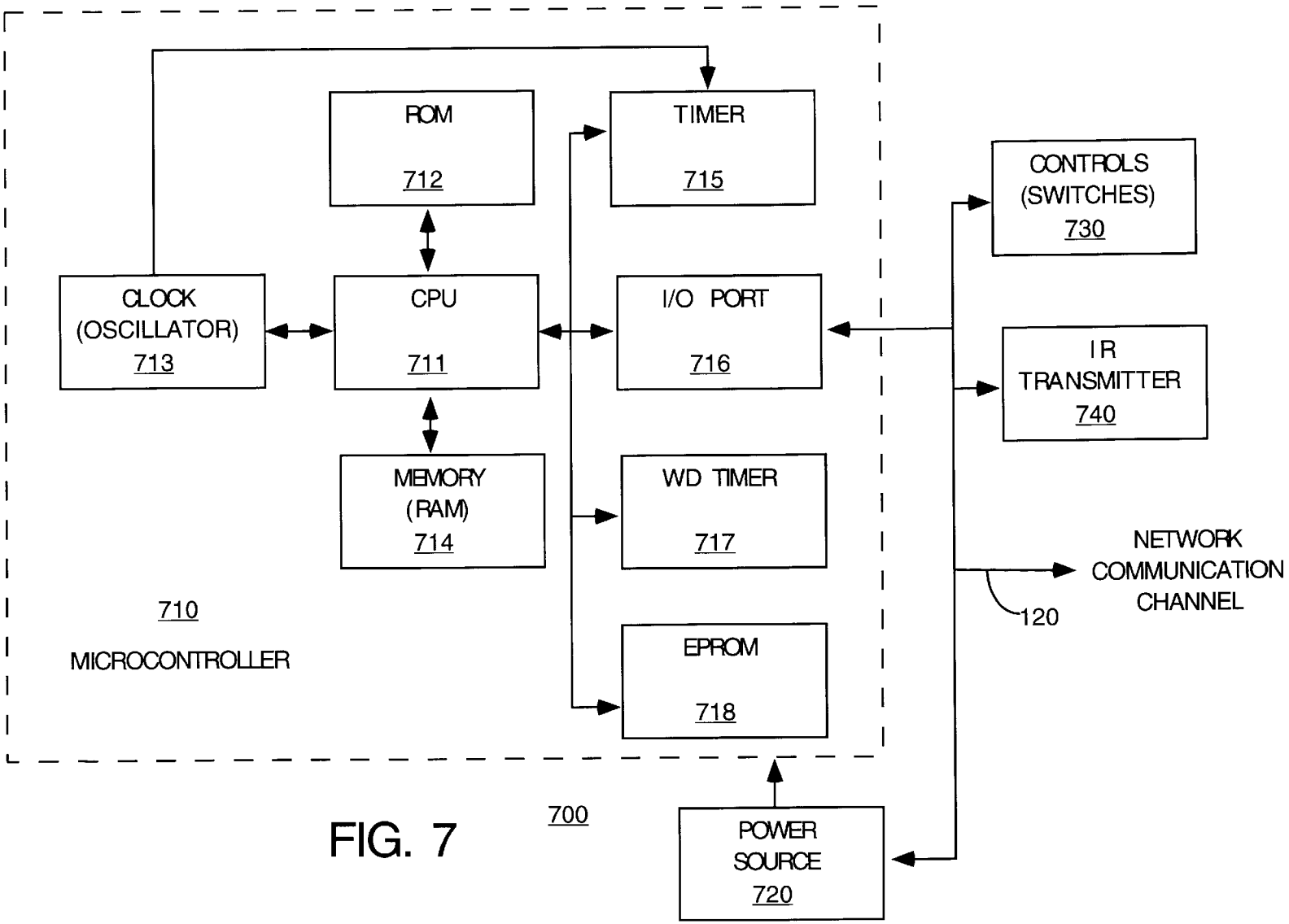
FIG. 7 depicts a block diagram of the EMU of the present invention.

FIG. 7 depicts a block diagram of the EMU 700 of the present invention. The EMU comprises a microcontroller 710, a power source 720, controls section 730, and an IR transmitter 740.

More specifically, the microcontroller 710 is similar to the microcontroller of 410 in FIG. 4. Although the microcontroller 710 shares similar hardware configuration to those of the badge, the microcontroller 710 is programmed with different software instructions to implement different features and functions that are described below.

In the preferred embodiment, the EMU is mounted to the ceiling of a monitored area (or potentially unsanitary environment), e.g., a restroom or a kitchen counter. In the preferred embodiment, the power source 720 is implemented as a part of the reminder and/or verification/monitoring system 100, i.e., power to the EMU is provided via the network interface of the system. However, power to the EMU can be implemented using batteries or a local AC power source.

The IR transmitter 740 is similar to that of the IR transmitter 450 of the badge 400. An important difference is the transmission volume which is generally greater in the IR transmitter 740. The purpose of the IR transmitter 740 is to transmit and direct an IR signal at a particular volume of space that is being monitored. The directed IR signal is intended to be received by a badge that traverses through the monitored area. In turn, responsive to the IR signal, the badge may activate a "violation timer" in the badge that sets a pre-defined time to perform a desired action or a set of actions. If the desired action is not performed within the pre-defined time, a violation is registered.

It has been observed that when the EMU is placed in a closed room with diffuse reflective walls (i.e. typical painted walls), the energy transmitted by the EMU tends to uniformly illuminate the walls due to scattered reflections. While a badge is located within the room, the amount of energy that the badge receives is typically dependent on the size of the room and the transmitted power from the EMU. This is due in part to the uniform illumination, fixed field of view, and the inverse square law. As such, the power transmitted by the EMU can be controlled to accommodate rooms with different volumes accordingly.

The result of this effect is that a room can be selectively "covered" by an EMU, where regions outside of the room are not "covered". The use of the signal transmitted directly without reflection and the scattered reflections, allow the areas covered, to be precisely controlled. This allows potentially unsanitary areas to be delineated from sanitary areas. Furthermore, the addition of moveable shields (not shown) to the EMU allow an even greater degree of control over the illuminated or "covered" area.

Controls section 730 provides configuration controls e.g., switches that allow configuration of the EMU by the user without having to return the EMU to the manufacturer to reconfigure the EMU settings. The following settings can be configured by the controls section 730: 1) the transmission intensity of the EMU, 2) the address of the EMU and 3) the type of monitored area or environment.

First, the transmission intensity of the EMU can be selected depending on the monitored area, where a higher transmission intensity is required for a larger volume of monitored space, e.g., a large room versus a smaller volume of monitored space, e.g., a kitchen counter or a wash sink. Second, if multiple EMUs are deployed, then unique addresses for the EMUs can be selected for identification purposes. Third, a group of settings can be programmed such that by selecting a type of monitored space, e.g., restrooms, kitchen, sinks, hallways and the like, the proper settings can be selected by simply choosing one of the type of monitored space, without having to choose each setting individually.

Figure 8:
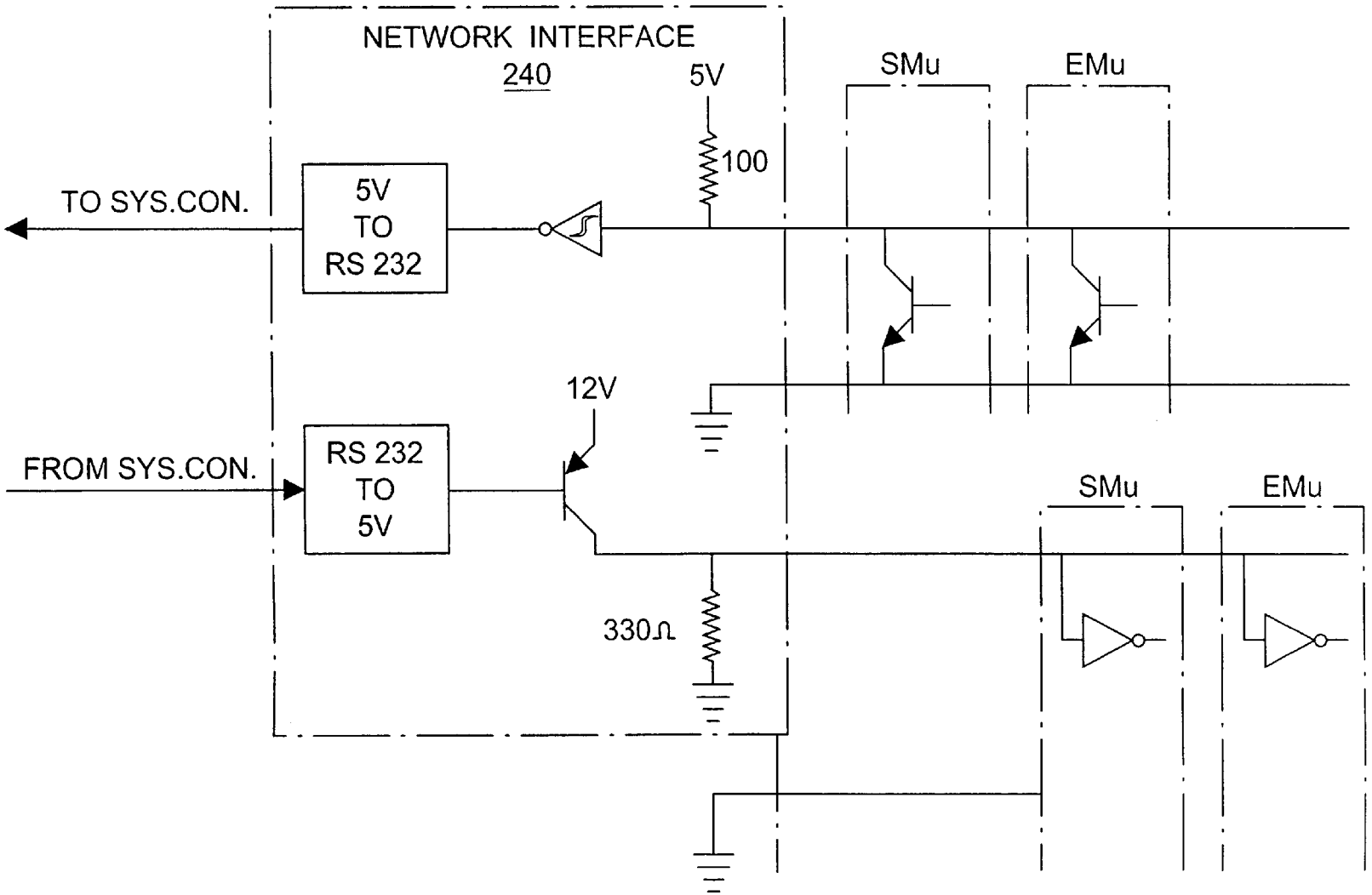
FIG. 8 illustrates a block diagram of the network interface circuit of the present invention.

FIG. 8 illustrates a block diagram of the network interface circuit 240 of the present invention. FIG. 8 illustrates two perspectives of the network interface circuit 240, where 1) a signal is passed from the system components to the system controller and 2) a signal is passed from the system controller to the system components.

More specifically, the network interface circuit 240 converts a 5 volt signal into a RS232 signal when the network components are communicating with the system controller.

In turn, the network interface circuit 240 converts a RS232 signal into a 5 volt signal when the system controller is communicating with the network components. Although the signal from the system controller is transmitted to all system components, only one system component with the specified ID (embedded in the signal) will be responsive to the signal. However, a system wide signal can be sent such that all components will respond, e.g., a reset signal or a system wide configuration signal.

In the preferred embodiment, the present protocol employs four bytes for communication, where the first byte is used to communicate an address (i.e., up to 256 addresses) of a system component that is to receive the present message. The second, third and fourth bytes are used to communicate a badge ID, a command and/or data, e.g., a command for issuing a satisfactory signal to a particular badge. The data transmitted with the command depends upon the nature of the command, which may include the address of a badge.

Figure 9:
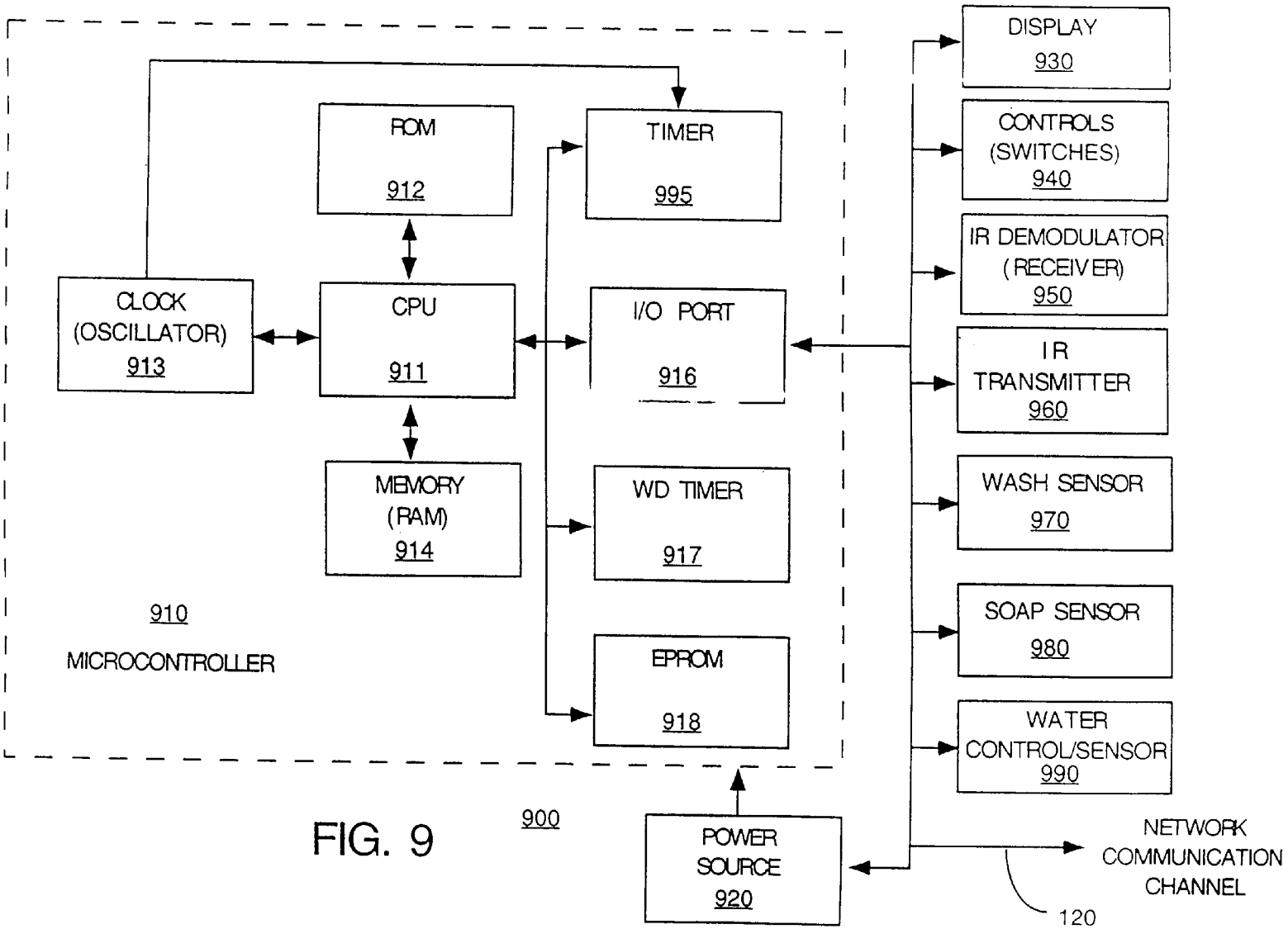
FIG. 9 illustrates a block diagram of the SMU of the present invention.

FIG. 9 illustrates a block diagram of the SMU 900 of the present invention. The SMU serves to detect a set of desired steps performed by the user of the badge. In the preferred embodiment, the desired steps include: 1) the activation of a soap dispenser, 2) the activation of the water controls of the wash sink and 3) (optionally) the placement of hands within the wash sink. The SMU comprises a microcontroller 910, a power source 920, a display 930, a controls section 940, an IR demodulator 950, an IR transmitter 960, a wash sensor 970, a soap sensor 980 and a water control sensor and/or water activation control 990.

More specifically, the microcontroller 910 is similar to the microcontroller of 710 in FIG. 7. Although the microcontroller 910 shares similar hardware configuration to those of the EMU, the microcontroller 910 is programmed with different software instructions to implement different features and functions that are described below.

In the preferred embodiment, the SMU is mounted proximate to an area where desired actions are performed, e.g., a wash sink. In the preferred embodiment, the power source 920 is implemented as a part of the reminder and/or verification/monitoring system 100, i.e., power to the SMU is provided via the network interface of the system. However, power to the SMU can be implemented using batteries or a local AC power source.

The display 930 serves to communicate with a user by displaying various messages, e.g., reminding the user to use soap before washing hands and the like. In fact, a speaker can be optionally employed to broadcast the displayed message.

In the present invention, the display 930 can be implemented using light emitting diodes or a liquid crystal display. In one embodiment, the messages are displayed in the form of backlit indicator icons. These universal icons can be implemented as a display sequence, i.e., each icon remains lit for a predetermined period of time, then the next icon will light up and so on. For example, the icon sequence may have the following steps:

Wet hands

Apply Soap

Scrub

Rinse

Dry thoroughly (& apply sanitizer).

Controls section 940 provides configuration controls e.g., switches that allow configuration of the SMU by the user without having to return the SMU to the manufacturer to reconfigure the SMU settings. The following settings can be configured by the controls section 940: 1) the transmission intensity of the SMU, 2) the address of the SMU and 3) the type of desired actions to be monitored.

First, the transmission intensity of the SMU can be selected depending on the proximate area where desired actions are performed, where a higher transmission intensity is required for a larger volume of monitored space, e.g., a larger trough like wash sink versus a smaller volume of monitored space, e.g., a kitchen counter or a wash sink. Second, if multiple SMUs are deployed, then unique addresses for the SMUs can be selected for identification purposes. Third, a group of settings can be programmed such that by selecting a type of desired actions to be monitored, e.g., washing hands in a wash sink, activating a disposable glove dispenser, and the like, the proper settings can be selected by simply choosing one of the type of monitored action, without having to choose each setting individually.

The IR transmitter 960 is similar to that of the IR transmitter 450 of the badge 400. An important difference is the transmission volume which is generally greater in the IR transmitter 960. The purpose of the IR transmitter 960 is to transmit and direct an IR signal at a particular volume of space that is being monitored for performance of the desired actions. The directed IR signal (commands/data) is intended to be received by a badge that is within the monitored area. In the preferred embodiment, the badge should be oriented so that the SMU is located in it's transmission cone. The commands sent to the badge may include, but are not limited to: activating an indicator on the badge (a buzzer or a LED), requesting the badge to transmit stored violations on the badge and the like (See command list in the Appendix).

In the preferred embodiment, the command/data transmitted by the SMU are generated by the system controller 110. Thus, in this capacity, the SMU simply serves as a transponder and sensor.

Alternatively, the system controller 110 can be omitted and the SMU can be programmed via the microcontroller to execute higher level functions. Thus, each SMU can independently manage and monitor an area.

The IR demodulator 950 is similar to that of the IR demodulator 440 of the badge 400. The "reception volume" of the IR demodulator 950 is generally greater than the transmission volume of the IR transmitter 450 of the badge. The purpose of the demodulator 950 is to receive a directed IR signal from the badge 150. The signal may comprise commands/data such as listed in the Appendix.

The soap sensor 980 serves to provide a signal to the SMU when it detects the activation of the soap dispenser 222. The soap sensor can be implemented using a proximity sensor (e.g., a non-contact optical sensor IRO-0010 from Infrared of New Jersey) or a simple mechanical contact or switch. In the preferred embodiment, when the user's hands are proximate to the soap dispenser, a system controller 110 which is polling periodically, will detect the presence of the user and will then request a corresponding SMU to query the identification of the user who has just depressed the soap dispenser. The SMU will then poll the badge via the IR transmitter 960 with a command for identification. If the badge responds with an ID number, the system controller will then monitor the amount of time that the user's badge is in communication with the SMU. This information can then be used to reach a conclusion as to the action taken by the user. In fact, once a communication link is established with the badge, the SMU may query for any other types of information, e.g., the number of recorded violations.

The wash sensor 970 serves to provide a signal to the SMU when it detects the presence of hands inside the wash sink 224. The wash sensor 970 can be implemented using a proximity sensor or a simple mechanical contact or switch.

The water control/sensor 990 serves to provide a signal to the SMU when it detects the activation of the faucets located on the wash sink 224. The water control/sensor 990 can be implemented using a proximity sensor or a simple mechanical contact or switch. Alternatively, the flow can be sensed by a pressure switch or by connection to existing water control systems.

Furthermore, the flow of water can also be controlled by the water control/sensor 990. The presence of the user's hands in the sink can be sensed by a proximity sensor and the water flow controlled. Namely, if the wash sensor 970 senses a user's hands (or any other sensor means), then water control/sensor 990 starts the flow of water by activating a solenoid valve.

It should be understood that any number of sensors for monitoring any number of desired actions can be employed to meet the requirement of a particular application. Thus, it is possible to implement one or more of the sensors disclosed above for the SMU.

Figure 10:
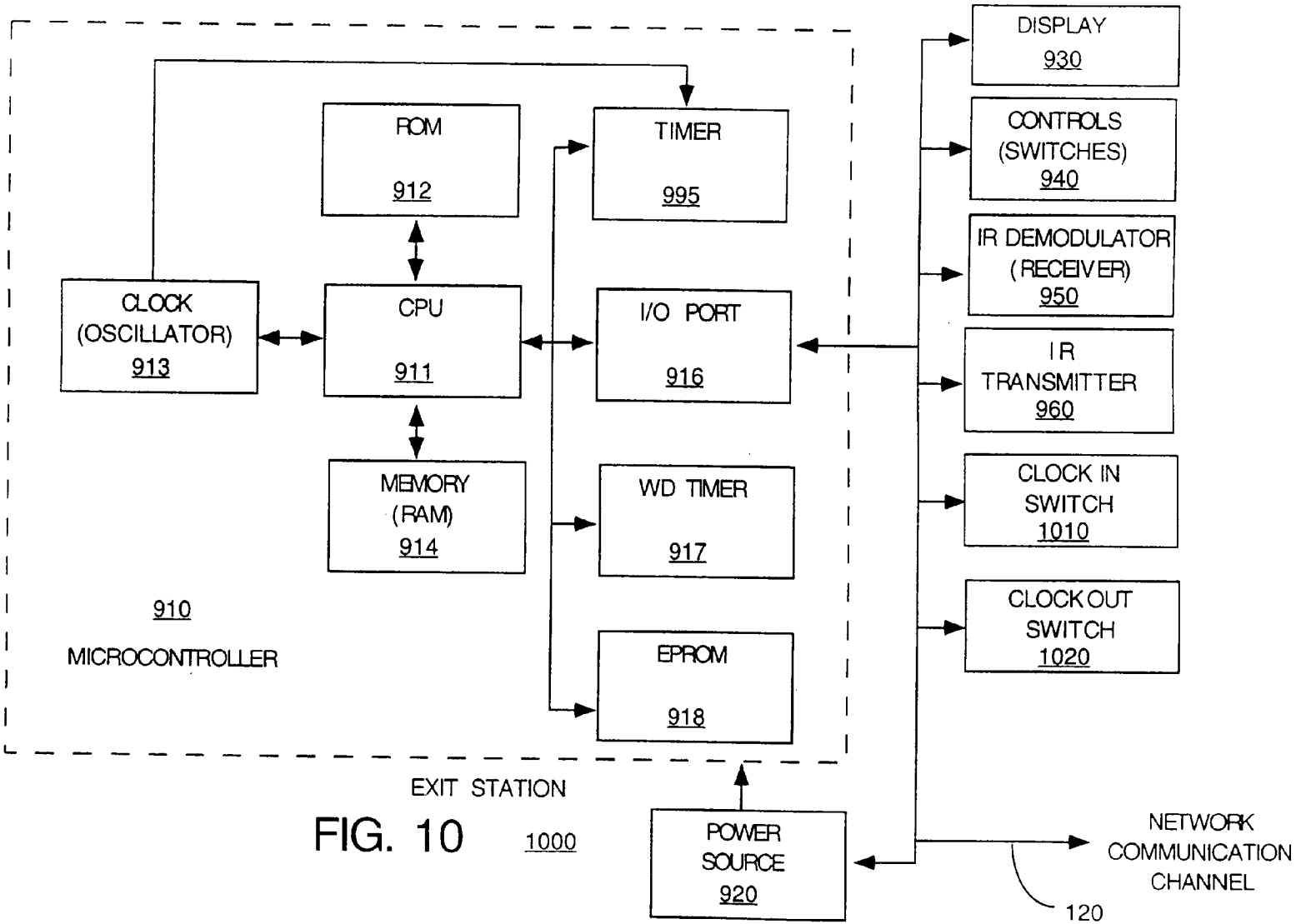
FIG. 10 illustrates a block diagram of the exit station of the present invention.

FIG. 10 illustrates a block diagram of the exit station 1000 of the present invention. The exit station 1000 utilizes similar components employed in the SMU. As such, the discussion of these components can be found above.

The "clock-in switch" 1010 and the "clock-out" switch 1020 are activated by the employee after placing his badge 150 into the exit station 1000. The system controller 110 periodically polls the exit station and when one of these switches is activated, the controller 110 may send commands via the exit station to control the function of the badge. For example, when the "clock-out" switch 1020 is activated, the periodic timer on the badge can be deactivated with the exit station to prevent the timer from causing violations while the badge is not being worn.

Furthermore, data stored in the badge can be uploaded to the system controller 110 as well. For example, violations stored in the badge can be uploaded to the system controller. In the preferred embodiment, the communication between the badge and the exit station is effected via an IR link.

Figure 11:
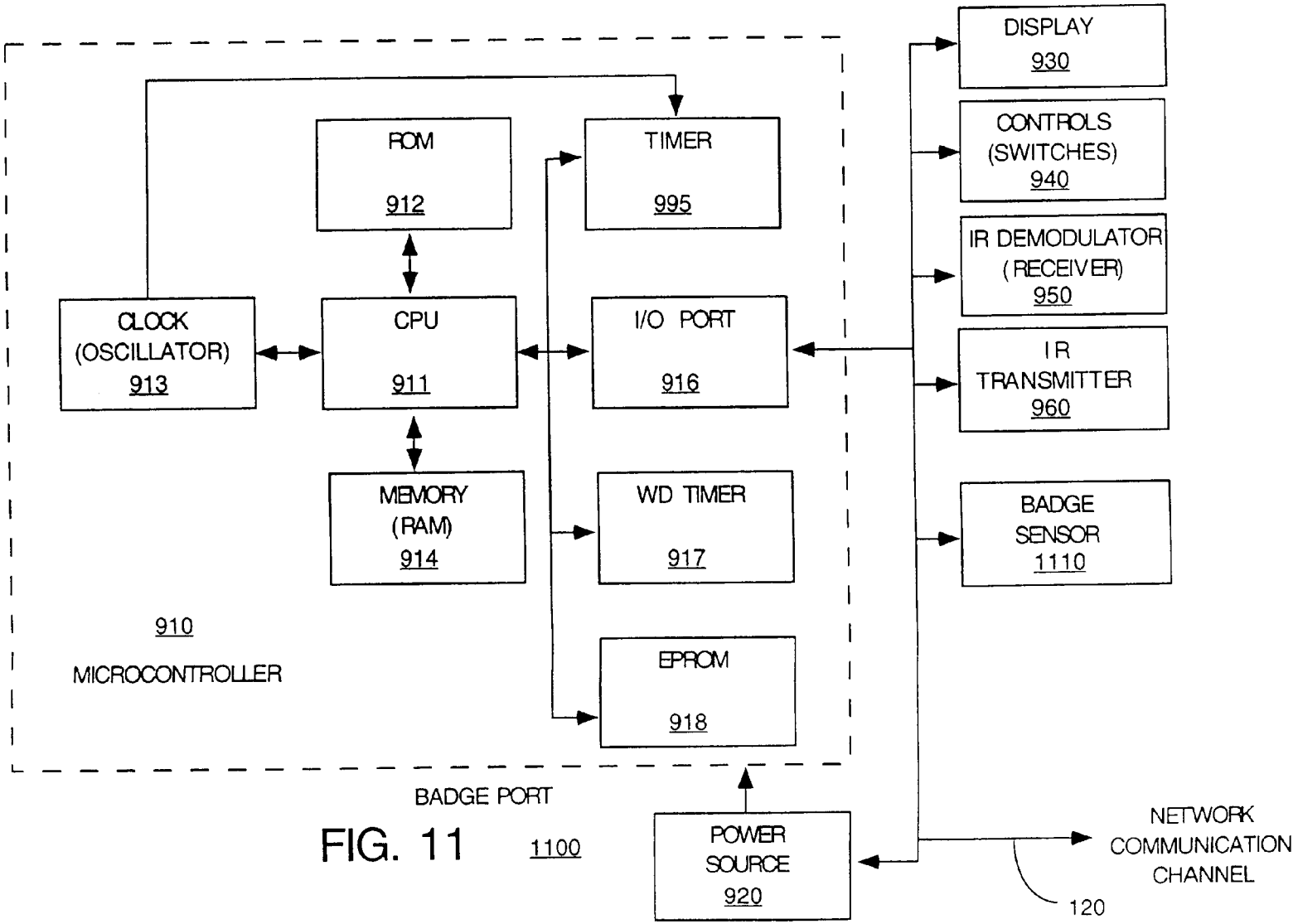
FIG. 11 illustrates a block diagram of the badge port of the present invention.

FIG. 11 illustrates a block diagram of the "badge port" 1100 of the present invention. The badge port 1100 utilizes similar components employed in the SMU. As such, the discussion of these components can be found above.

The badge sensor 1110 detects that a badge 150 has been placed into the badge port 1100. The system controller 110 polls the badge port and upon detection of a badge, uploads the badge control configuration and ID and displays the information to the system operator. The badge configuration and ID can be changed via infrared commands transmitted from the badge port to the badge. In this fashion, badges can be shipped from the factory in a default state with the ID blank and these parameters can be changed at the discretion of the system operator by the use of the badge port. Alternatively, a locally controlled badge port will have the system controller functions integrated into it's microcontroller, thereby allowing the badge port to function independently of the network.

In fact, the present invention describes a complex reminder and/or verification/monitoring system having a plurality of system components. However, it is possible to implement the present invention in whole or in part to derive a series of different monitoring systems having different complexity. For example, a less complex reminder system may simply incorporate a badge that will trigger an indicator (buzzer or light) periodically as a reminder to perform a desired action. In contrast, a more complex system may incorporate one or more EMUs and/or SMUs without the use of a network or a system controller. Finally, a very complex system may comprise a system controller implemented in a network environment to control a plurality of badges, SMUs, and EMUs.

It should be understood that although the present invention is described above in specific embodiments, the present invention can be alternatively implemented in whole or in part using discreet components, application specific integrated circuit (ASIC) and/or software applications in combination with various hardware, e.g., a general purpose processor or microcontroller.

Furthermore, although the present invention is implemented using IR signal as the preferred communication medium, it should be understood that the present invention can be modified to use other communication means such as radio waves, sound waves and the like.

Figure 12:
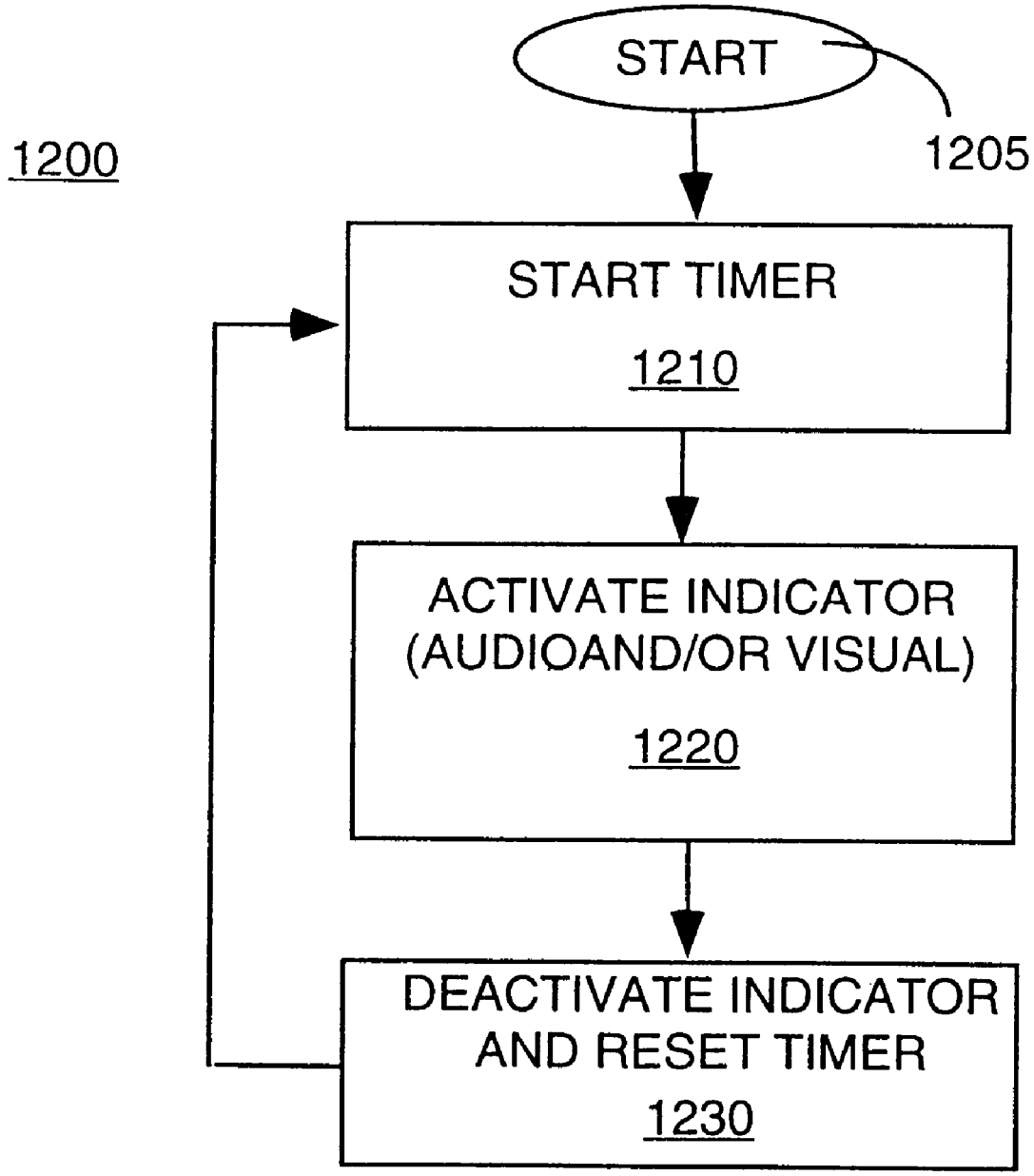
FIG. 12 is a flowchart that illustrates a method of operation in accordance with the present verification/monitoring system.
Figure 13:
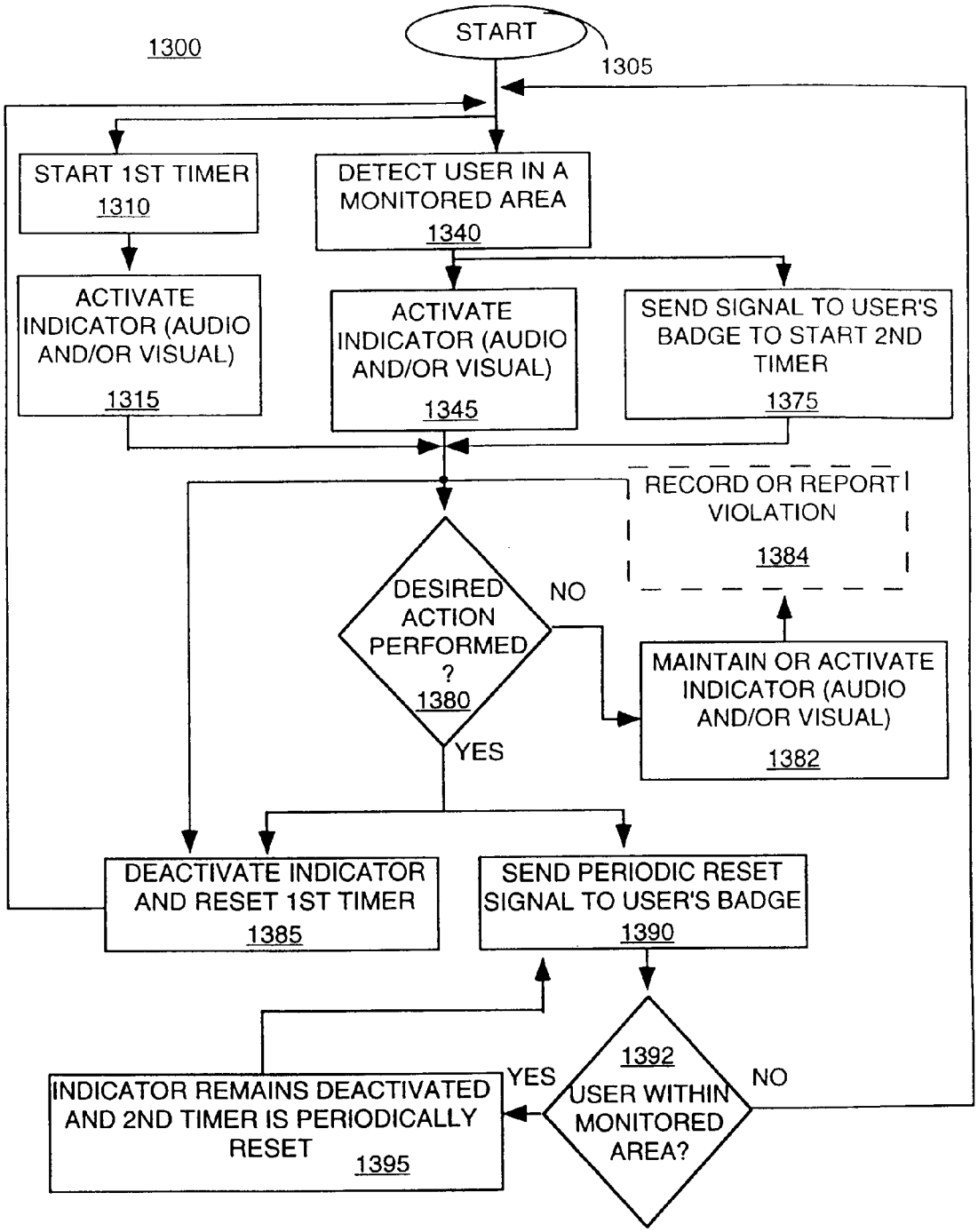
FIG. 13 is a flowchart that illustrates an alternate method of operation in accordance with the present verification/monitoring system.

FIGS. 12 and 13 are flowcharts that illustrate various exemplary methods of operation in accordance with the present flexible verification/monitoring system. Referring to FIG. 12, method 1200 illustrates a method of operation for a monitoring system that only employs an indicator, e.g., a badge 150.

More specifically, method 1200 starts in step 1205 and proceeds to step 1210, where a timer or counter, e.g., a periodic timer as discussed above, is started on the badge. The timer counts down from a predefined time value that is selectively programmed into the badge, e.g., 30 minutes, 60 minutes, 180 minutes and so on. In the preferred embodiment, the timer is typically started when a user starts wearing the badge or when the badge is physically removed from a storage device, e.g., a badge rack, a badge port or an exit station.

In step 1220, when the predefined time value has been reached, the indicator on the badge is activated. In the preferred embodiment, a buzzer starts to beep, e.g., two beeps every eight seconds for five beep sequences or "indicator sequences" (i.e., approximately 40 seconds). Additional or alternative indicators can be employed, e.g., displays, or flashing light emitting diodes (LEDs).

In step 1230, at the end of the indicator sequences, method 1200 deactivates the indicator and resets the timer and returns to step 1210. Method 1200 continues the loop until the badge is deactivated, e.g., the badge is returned to the storage device.

Referring to FIG. 13, method 1300 illustrates a method of operation for a reminder and/or verification/monitoring system that may employ various components, e.g., a badge 150, one or more SMUs 130, one or more EMUs 140, a controller and various accessories. Method 1300 starts in step 1305 and proceeds to steps 1310, 1340, and 1370.

More specifically, method 1300 illustrates different modes of operations, where these modes can be implemented in part or in whole. In step 1310, as in the case of step 1210 of FIG. 12, a first (1st) timer or counter, e.g., a periodic timer is started on the badge. The timer counts down from a predefined time value that is selectively programmed into the badge.

In step 1315, when the predefined time value has been reached, the indicator on the badge is activated. The indicator informs the user that a desired action, e.g., washing the user's hands, must be performed.

In step 1340, method 1300 detects a user in a monitored area, e.g., a restroom, a wash sink, or a kitchen counter or station. The detection of the user can be implemented in different fashions, e.g., the badge initiates a communication with a SMU, the SMU broadcasts a periodic signal into the monitored area or the EMU broadcasts a periodic signal into the monitored area.

In step 1345, when the user is detected in the monitored area, the indicator on the badge is activated. The indicator informs the user that the user has encountered a monitored area and a desired action, e.g., washing the user's hands, must now be performed.

Alternatively, in step 1375, when the user is detected in the monitored area, the indicator on the badge is not immediately activated. Instead, a signal is sent to the badge to start a second (2nd) timer. The delay in activating the indicator of the badge, allows the user sufficient time (e.g., selectively set to three minutes) to perform the desired action, e.g., washing the user's hands, without the need to trigger the indicator on the badge. This alternative approach conserves power on the badge and minimizes the need to remind a user who is already adhering to predefined hygienic practices.

In step 1380, method 1300 queries whether the desired action was performed by the user. If the query is negatively answered, then method 1300 proceeds to step 1382, where the indicator on the badge is maintained or activated if the indicator has not been previously activated. In fact, additional indicators can be activated or the indicator sequence can be modified, e.g., more beeps at higher pitch.

In step 1384, after a period of time (e.g., a violation time period), method 1300 may optionally record or report the failure to perform the desired action as a violation against the user. Again, the recordation or reporting of such violations can be implemented in different fashions, e.g., the badge may store the violation internally on a storage device, e.g., nonvolatile memory, the SMU may store the violation internally on a storage device, e.g., non-volatile memory, or the SMU may immediately report the violation to a controller that has the capability to store such violations and to generate various reports. In turn, method 1300 may return to step 1380 where it continuously queries whether the desired action is performed or it may optionally return to step 1385, where the indicator is deactivated and the timer is reset.

Returning to step 1380, if the query is negatively answered, then method 1300 proceeds to step 1385 or step 1390. Namely, two different modes of operation can be implemented.

In step 1385, if the desired action was performed, method 1300 deactivates the indicator and resets the first timer. Method 1300 then returns to the top of the loop.

Alternatively, in step 1390, if the desired action was performed, method 1300 then sends a periodic reset signal to the user badge. The reset signal is used to reset the second timer.

In step 1392, method 1300 queries whether the user is still within the monitored area. Again, the detection of the user can be implemented in different fashions, e.g., by periodically sending a reset signal to the user's badge from an EMU. If the query is negatively answered, then method 1300 returns to the top of the loop. If the query is positively answered, then method 1300 proceeds to step 1395, where the indicator on the badge remains deactivated while the second timer is periodically reset. Namely, as long as the user remains in the monitored area, a periodic reset signal is sent to the badge to prevent the indicator from being activated. One feature of this implementation is that a user is allowed to leave a monitored area for a predefined period of time without having the indicator being activated. Finally, method 1300 then returns to step 1390.

Method 1300 will continue the loop until the badge is deactivated, e.g., the badge is returned to the storage device.

It should be noted that method 1300 illustrates various different and useful modes of operation. First, the indicator on the badge can be activated upon encountering a monitored area, e.g., a potentially unsanitary area such as a restroom. Alternatively, the indicator on the badge is activated only upon leaving a monitored area, e.g., a potentially sanitary area such as a kitchen area. For example, as long as the user remains in the kitchen area, a reset signal can be received from an EMU to reset the second timer on the badge.

Furthermore, since various modes of operation can be combined, it is also possible to encourage frequent hand washing by the user even if the user does not leave the monitored area. For example, the first timer is used to activate the indicator on the badge every two hours even if the user does not leave the kitchen area within that time frame. Thus, the present apparatus is a very flexible reminder and/or verification/monitoring system that allows various modes of operation that can be tailored to the requirements of a particular application.

Although various embodiments which incorporate the teachings of the present invention have been shown and described in detail herein, those skilled in the art can readily devise many other varied embodiments that still incorporate these teachings.

What is claimed is:

1. A monitoring apparatus for promoting hygienic practices, said apparatus comprising:

a central processing unit (CPU);

a sensor, coupled to said CPU, for sensing a performance of a desired action by a user;

a transmitter, coupled to said CPU, for transmitting a satisfactory signal to said user, when said CPU determines that said desired action has been performed by said user;

a badge worn by said user;

a receiver mounted to said badge from receiving said satisfactory signal from said transmitter;

at least one communication medium or reminder indicator mounted to said badge and operatively connected to said receiver for communicating to said user that said desired action has been performed by said user; and at least one switch mounted to said badge and operatively connected to said communication medium or reminder indicator for configuring settings of said communication medium or reminder indicator in response to an electronic or electrical signal from outside said badge.

2. The monitoring apparatus of claim 1, further comprising a display, coupled to said CPU, for displaying a visual signal to indicate said desired action.

3. The monitoring apparatus of claim 2, wherein said visual signal is an icon.

4. The monitoring apparatus of claim 2, wherein said visual signal is a displayed message.

5. The monitoring apparatus of claim 1, wherein said sensor is a soap sensor.

6. The monitoring apparatus of claim 1, wherein said sensor is a wash sensor.

7. The monitoring apparatus of claim 1, wherein said sensor is a water control sensor.

8. The monitoring apparatus of claim 1, wherein said sensor is a receiver for communicating with a transmitter worn by said user.

9. The monitoring apparatus of claim 1, further comprising a receiver for communicating with a transmitter worn by said user.

10. The monitoring apparatus of claim 9, wherein said receiver is an infrared receiver.

11. The monitoring apparatus of claim 1, wherein said transmitter is an infrared transmitter.

12. The monitoring apparatus of claim 1, wherein said CPU is implemented using a microcontroller.

13. A monitoring apparatus for promoting hygienic practices, said apparatus comprising:

a central processing means;

a sensing means, coupled to said central processing means, for sensing a performance of a desired action by a user; and a transmitting means, coupled to said central processing means, for transmitting a satisfactory signal to said user, when said central processing means determines that said desired action has been performed by said user, said central processing means being programmed to:

track information including the times, frequency and locations of potentially unsanitary environments encountered by said user throughout a work shift;

record information including said user's failure to complete said desired action upon encountering said potentially unsanitary environments;

generate a report from the tracked and recorded information.

14. The monitoring apparatus of claim 13, further comprising a displaying means, coupled to said central processing means, for displaying a visual signal to indicate said desired action.

15. The monitoring apparatus of claim 13, further comprising a receiving means, coupled to said central processing means, for communicating with a transmitter worn by said user.

16. Method for promoting hygienic practices, said method comprising the steps of:

(a) broadcasting, within a directed volume of space only, a directional wireless signal from a badge worn by a user;

(b) in response to said directional wireless signal, sensing the performance of a desired action by a user; and (c) transmitting a satisfactory signal to said user, when said desired action has been performed by said user.

17. The method of claim 16, further comprising the step of:

(a') activating an indicator worn by said user for indicating that a desired action should be performed by said user prior to said step (a).

18. The method of claim 16, wherein said sensing step (a) comprises the step of sensing the operation of a soap dispenser.

19. The method of claim 16, wherein said sensing step (a) comprises the step of sensing a hand of said user being proximate to a sink.

20. The method of claim 16, wherein said sensing step (a) comprises the step of sensing the operation of the faucets.

* * * * *